United States Patent [19]

Takasaki

[11] Patent Number: 4,747,552

[45] Date of Patent: May 31, 1988

[54] ROLL GRINDING BLADE

[76] Inventor: Takao Takasaki, 4-7, Iwasaki 2-Chome, Nichinan, Miyazaki 887, Japan

[21] Appl. No.: 851,140

[22] PCT Filed: Jul. 31, 1985

[86] PCT No.: PCT/JP85/00430

§ 371 Date: May 20, 1986

§ 102(e) Date: May 20, 1986

[87] PCT Pub. No.: WO86/00824

PCT Pub. Date: Feb. 13, 1986

[30] Foreign Application Priority Data

Jul. 31, 1984 [JP] Japan ..... 59-162152

[51] Int. Cl.[4] ..... B02L 18/18

[52] U.S. Cl. ..... 241/292.1; 241/195

[58] Field of Search ..... 241/292.1, 293, 294, 241/194, 195; 83/663

[56] References Cited

U.S. PATENT DOCUMENTS 1,375,862 4/1921 Shelton ..... 241/194

3,039,505 6/1962 Mast ..... 241/292.1

FOREIGN PATENT DOCUMENTS 179155 2/1984 Japan .

*Primary Examiner*—Timothy V. Eley

*Attorney, Agent, or Firm*—Cushman, Darby & Cushman

[57] ABSTRACT

A blade for a grinding roll of a roll grinding machine for the production of starch from starch plants such as potatoes and for the production of processed food or juice from root crops, fruits, vegetables or the like, the blade including a plurality of planar blade elements coupled together in side-by-side, parallel relation so as to define a stack of blade elements. Each of the blade elements is a flat, rhombic shape so as to include two acute angled corners, two obtuse angled corners and four cutting edges disposed about its periphery. The blade is preferably mounted to the grinding roll so that the blade elements are disposed substantially parallel to the circumferential surface of the roll. A blade formed in accordance with the present invention has an increased number of cutting blade edges because of the stacking of the rhombic blade members and where the blade members are mounted to the roll so that the acute angled corners thereof are oriented in the circumferential direction, grinding of the materials to be processed is significantly improved.

2 Claims, 2 Drawing Sheets

ROLL GRINDING BLADE

TECHNICAL FIELD

This invention concerns a roll grinding blade for the production of starch from starch plants such as potatoes, as well as for the production of processed food or juice such as from root crops, fruits and vegetables.

BACKGROUND ART

Conventional trigonal cone- and saw teeth-like roll grinding blades have a drawback that the product recovery rate is lowered as the grinding efficiency is increased.

That is, the roll grinding blades for the production of sweet potato starch have trigonal cone-like blade elements sets to a rotational roll made of highly soft steels, in which the best starch recovery rate is obtainable when the easily abrading blade elements are abraded such that the crests of the trigonal cones are abraded by about one-half into a trapezoidal shape. However, the blade elements abraded to the trapezoidal shape involve a defect that not only the grinding efficiency is reduced but also they fail to perform complete grinding, for example, by yielding chips, i.e., waste pieces of potatoes, thus requiring re-grinding by a grinder.

There has been a roll grinding machine for the production of Irish potato starch having saw teeth-like grinding blades which can detachably be mounted to a roll but, since the saw teeth-like shape undergoes a great resistance and requires abrasion, it has a defect that the detaching and attaching device to the roll is complicated to increase the cost and that it cannot be utilized for the production of sweet potato starch because of the low product recovery rate.

Grinding of root crops, fruits, vegetables, etc. by a grinder for the production of processed food or juice therefrom involves a demerit of poor fabrication efficiency.

The cutter of a juicer also has a defect that the blade elements, being of a trigonal cone- or trigonal plate-like shape, are not satisfactorily bite into the material to be processed and are abraded rapidly.

The rotational blade shown in Japanese Patent Application No. Sho 59-937431 also has a drawback that the grinding efficiency is reduced if the starch recovery rate is increased.

That is, all of the conventional grinding blades have a conflicting relationship between the product recovery rate and the grinding efficiency. Therefore, they are defective in that the grinding efficiency can not be improved.

The conflicting relationship between the product recovery rate and the grinding efficiency is caused by that all of the blade elements of the conventional grinding blades are mono-layered blades.

The objects of this invention is to overcome the problems in the drawbacks of the conventional mono-layered blades and provide a grinding blade capable of improving the grinding efficiency remarkably without reducing the quality or the recovery rate of products.

DISCLOSURE OF INVENTION

Accordingly, this invention basically concerns a stacked blade which is suitable to the grinding of matters to be processed such as the pulverization of starch cell membranes and formed by stacking protruding plate-like blade members as desired.

Specifically, this is a blade member comprising protruding plate-like blade elements each of a flat and rhombic planar shape and having leading blade tips at the top ends on the left and right sides meeting each other with an acute angle and cutting blade tips at the respective edges thereof where the side surfaces meet the upper and the lower surfaces, which are stacked by an appropriate number as desired.

The roll grinding blade has a feature in that the stacked blade members are arranged at the circumferential surface of a rotational roll with the leading blade tips being directed to the rotating direction, by any method such as of mounting fixedly or detachably to the rotational roll.

BRIEF DESCRIPTION OF THE DRAWINGS

The drawings show an embodiment of the roll grinding blade according to this invention, wherein.

BEST MODE FOR CARRYING OUT THE INVENTION

For describing this invention more in detail, an embodiment for the best mode will be explained hereinafter in accordance with the appended drawings.

Figure 1:
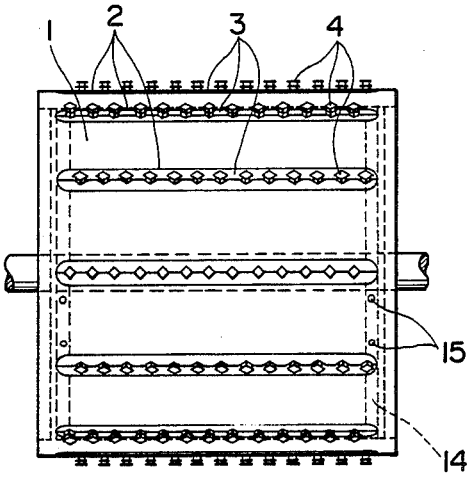
FIG. 1 is a front elevational view of the roll grinding blade according to this invention.
Figure 2:
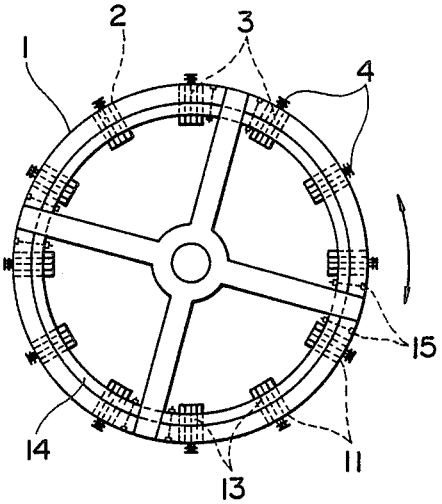
FIG. 2 is a side elevational view thereof.
Figure 3:
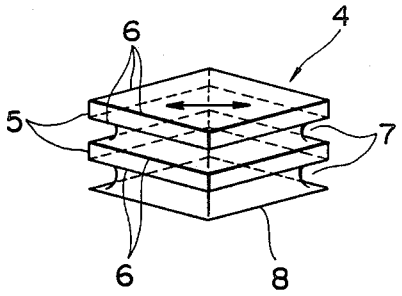
FIG. 3 is an enlarged perspective view of a blade member of the roll grinding blade as a main portion of this invention.
Figure 4:
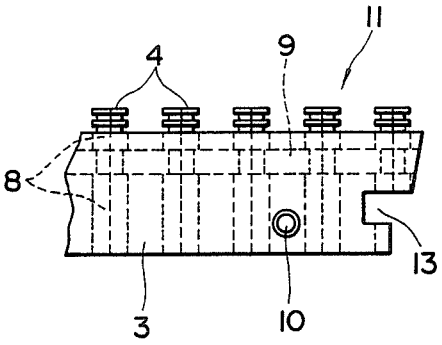
FIG. 4 is a front elevational view of a blade with base.
Figure 5:
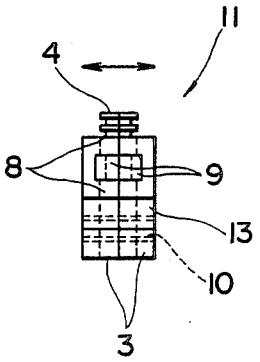
FIG. 5 is a side elevational view thereof.
Figure 6:
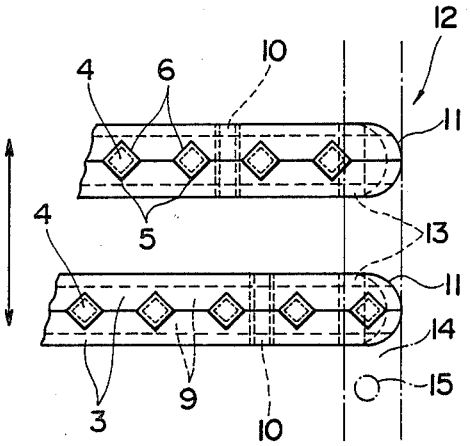
FIG. 6 is a plan view of a combined blade in which the blade members are arranged, arrows in FIGS. 2, 3, 5 and 6 showing the rotating direction.

FIGS. 1 and 2 show a roll grinding blade in which detachable blade members 4 with base 3 are attached to recessed holes 2 formed in a roll 1. FIG. 3 is an enlarged perspective view of a blade member 4 on the roll in which a plurality of protruding plate-like blade elements with leading blade tips 5 and cutting blade tips 6 are formed by stacking them by way of recessed grooves 7. FIGS. 4, 5 and 6 show blades 11 with base in which blade legs 8 of the blade members 4 are disposed at a predetermined distance on the base 3 and seized between securing plates 9 and rivetted at 10. Securing with adhesives may also be employed instead of rivetting at 10. A plurality of the blades 11 with base constitute a combined blade 12 in which the blade members 4 are situated while being staggered from each other as shown in FIG. 6. They are fitted into the recessed holes 2 in the roll 1, rings 14 are fitted to the recesses 13 on both ends of the blades 11 with base, and the rings 14 are secured by screws 15 to the roll 1.

Accordingly, it is suitable to the grinding of matters to be processed such as pulverization of starch cell membranes. The blade member comprising the stacked protruding plate-like blade elements can be made greater in the blade height than the mono-layered blade member and contain a number of acute cutting blade tips 6, i.e., breaking lines and blade members bite well into the matters to be processed with no objection. The rhombic blade member having leading blade tips at both ends can detachably be mounted to the roll and the blade member can be formed with abrasion resistant material such as tungsten or ceramic.

The blade members can detachably be mounted also to the inner surfaces of cylindrical, conical, net-shaped or like other rolls, as well as to a rotating disk such as the cutter of a juicer.

Thus, the grinding efficiency can significantly be increased without reducing the quality or the recovery rate of the product by the blade members, in which protruding plate-like blade elements are stacked. Further, it can perform grinding with no requirement for running water, is suitable to pulverization and also enables operation over a long period of time by the use of the blade members capable of withstanding long time use.

INDUSTRIAL APPLICABILITY

As has been described above, this invention is useful as a grinding blade of a roll grinding machine for the production of starch from starch plants such as potatoes, as well as for the production of processed food or juice from root crops, fruits, vegetables, etc. in that it can improve the grinding efficiency by from 2 to 3 times or greater than that of the conventional machines.

Further, it is useful as a roll grinding blade or roll pulverization blade capable of grinding and pulverizing fabrication at high efficiency over a broad range from agricultural, forestry, stock breeding and marine products to industrial and mineral products, such as grinding of chicken heads including both soft and hard textures, as well as pulverization of fish meat products, crops, wood materials and plastics.

Furthermore, it is also useful being utilizable as blade members for the rotating disk such as the cutter of a juicer or the like.

I claim:

1. A blade for a grinding roll of a roll grinding machine comprising:

a plurality of planar blade elements coupled together in bottom-to-top, parallel relation so as to define a stack of blade elements, each said blade element having a flat, rhombic shape so as to include two acute angled corners, two obtuse angled corners and four cutting edges disposed about the periphery thereof, said stack of blade elements being adapted to be mounted to the grinding roll such that each said blade element is substantially parallel to a circumference of said grinding roll.

2. A blade as in claim 1, wherein said stack of blade elements includes at least two blade elements.

* * * * *